US009586114B1

(12) United States Patent
Chalifoux

(10) Patent No.: US 9,586,114 B1
(45) Date of Patent: Mar. 7, 2017

(54) SNAP COMPRESSION INTERCHANGEABLE GOLF GRIP

(71) Applicant: Paul Chalifoux, Naples, FL (US)

(72) Inventor: Paul Chalifoux, Naples, FL (US)

( * ) Notice: Subject to any disclaimer, the term of this patent is extended or adjusted under 35 U.S.C. 154(b) by 0 days.

(21) Appl. No.: 15/287,349

(22) Filed: Oct. 6, 2016

Related U.S. Application Data

(63) Continuation-in-part of application No. 15/138,162, filed on Apr. 25, 2016, now Pat. No. 9,452,333.

(51) Int. Cl.
*A63B 53/14* (2015.01)

(52) U.S. Cl.
CPC ..... *A63B 60/14* (2015.10); *A63B 53/14* (2013.01); *A63B 60/52* (2015.10)

(58) Field of Classification Search
CPC ..... A63B 53/14; A63B 60/14; A63B 60/52
See application file for complete search history.

(56) References Cited

U.S. PATENT DOCUMENTS 3,915,021 A * 10/1975 Schwartz ..... B23B 31/40 473/300
5,024,438 A * 6/1991 Candow ..... A63B 53/06 135/76
5,524,885 A * 6/1996 Heo ..... A63B 49/08 473/298
5,584,482 A * 12/1996 Huang ..... A63B 49/08 473/301
5,728,023 A * 3/1998 Green ..... F16G 1/22 474/206
5,730,662 A * 3/1998 Rens ..... A63B 60/08 16/DIG. 12
6,656,057 B2 * 12/2003 Manual ..... A63B 53/14 473/300
6,837,812 B2 * 1/2005 Falone ..... B25G 1/01 2/267
7,013,533 B2 * 3/2006 Lumpkin ..... B62K 21/26 16/421
7,118,598 B2 * 10/2006 Michelson ..... A61F 2/4455 623/17.11
7,806,600 B2 * 10/2010 Marrs ..... G02B 6/3802 385/55
8,177,658 B1 * 5/2012 Johnson ..... A63B 53/14 473/297
8,337,322 B2 * 12/2012 Harper ..... A63B 57/50 473/286
8,419,566 B2 * 4/2013 Gill ..... A63B 53/14 473/299
8,572,818 B2 * 11/2013 Hofmann ..... B60R 13/0206 24/297
D709,345 S * 7/2014 Reitano ..... B25G 1/102 D8/107
2002/0022533 A1 * 2/2002 Churovich ..... A63B 53/14 473/296
2007/0111815 A1 * 5/2007 Cheng ..... A63B 53/10 473/300
2012/0142444 A1 * 6/2012 Chol ..... A63B 53/10 473/296

(Continued)

FOREIGN PATENT DOCUMENTS

GB 352462 A * 7/1931 ..... A63B 53/14

*Primary Examiner* — Stephen Blau

(57) ABSTRACT

An interchangeable golf grip is secured by a snap compression unit that enters into a golf club shaft. The compression unit includes multiple expansion capabilities.

10 Claims, 9 Drawing Sheets

(56) References Cited

U.S. PATENT DOCUMENTS

| | | | | |
|---|---|---|---|---|
| 2013/0344977 | A1* | 12/2013 | Chalifoux | A63B 53/16<br>473/299 |
| 2015/0231462 | A1* | 8/2015 | Chapin | A63B 60/34<br>473/300 |

* cited by examiner

SNAP COMPRESSION INTERCHANGEABLE GOLF GRIP

CROSS REFERENCE TO RELATED U.S. PAT. NO. 9,452,333 B1

This application is a Continuation-in-Part application and claims the benefit of and takes priority from U.S. Pat. No. 9,452,333 B1 filed on Apr. 25, 2016, and issued on Sep. 27, 2016, art unit 3711, class-subclass 473-299000, the contents of which are hereby incorporated by reference.

BACKGROUND

Field of the Invention

The present invention refers to a method allowing quick placement and quick removal of golf grips onto a golf club. Quick change of golf grips allow golfers to try different golf grips on golf clubs before purchasing one. Quick change of golf grips further allows easy replacement of worn golf grips. Present methods to change a golf grip requires cutting off a golf grip, removing adhesive tape, reapplying adhesive tape, applying a slippery agent such as acetone and sliding on a new grip.

The present invention further allows perfect placement of a golf grip. If a golf grip is placed onto a golf club shaft and it is discovered to be misaligned, it is easily repositioned. It is further designed to allow different placement that makes a golf club longer or shorter.

DESCRIPTION OF CONCURRENT ART

Golf grips aid a golfer in holding a golf club. Golf clubs include drivers, woods, irons, wedges and putters. Present grips come in a wide variety of sizes, shapes, colors, materials, textures, tapers, and the like. It is difficult to evaluate which grip fits a golfer's hand best and works best as a golfer cannot try them on a golf club and strike balls. Presently, a golfer evaluates how a grip feels in their hand with no golf club attached to the grip. If a golfer likes the feel of a grip in their hand, the grip is permanently attached to a club. If grips are attached to a golfer's clubs and they do not like them, it is an expensive and time consuming process to replace them.

Present technology to change a golf grip requires cutting off a golf grip, removing adhesive tape, reapplying adhesive tape, applying a slippery agent such as acetone and sliding on a new grip. The process is complex enough that most golfers do not change their own grips but have professionals do it for them. Professional regripping is expensive and time consuming. The process makes it difficult for a golfer to effectively evaluate grips.

It would be advantageous to have grips that simply slide onto a shaft and are secured with a simple turn of a component. It would be advantageous to have a technique that allows grips to be placed and removed in seconds for better selection at point of purchase and ease of replacement. It would be further advantageous for a golfer to be able to adjust a grips position as required to perfect alignment with the club head or adjust a club length.

The United States Golf Association, referred to as the USGA, has specific rules for golf equipment that a golfer must follow for use in tournaments and professional play. USGA rules define specifications for grip shape, size, position and the like. One of the USGA rules is that a golf club and its components cannot easily be adjusted by a golfer during play. To change or adjust components on golf equipment, a special tool is required to adhere to USGA rules. The present invention has unique features created specifically to follow these rules.

SUMMARY OF THE INVENTION

The instant apparatus and system, as illustrated herein, is clearly not anticipated, rendered obvious, or even present in any of the prior art mechanisms, either alone or in any combination thereof. A versatile system, method and series of apparatuses are revealed for creating and utilizing compression techniques to secure golf grips and make them easily interchangeable.

The proposed golf grip includes a compression unit which enters into a golf club shaft. A golf grip is placed onto a golf club shaft such that a compression unit enters the shaft. When the compression unit is engaged, the grip is secured.

Previous U.S. Pat. No. 9,452,333 B1 for the continuation in part provides an effective method to fix a golf grip to a golf shaft however, it fits only one size shaft. Rotation of a central key moves over ramps to engage a smaller inner diameter and expand a compression unit. Common golf shafts are 0.580", 600" and 620" in diameter at the butt end. The present invention allows compression of multiple diameter golf shafts with one compression unit. The same principle is used but a series of ramps create multiple key positions and amount of compression unit expansion.

In the preferred embodiment, golf grips consist of a core which is surrounded by rubber, plastic or like materials to form a grip. The core is constructed of plastic, metal, rubber, ceramic, wood or any other common materials or combinations of materials. Materials added to the outside form individual shape, texture, color and the like.

A core fits over a golf club shaft. In the preferred embodiment, it expands over a shaft as it slides down to a final position. The core may be passive but in the preferred embodiment, it maintains constant compression onto a golf shaft. The resulting friction stabilizes a grip.

The core is constructed inside a golf grip and is placed directly onto a golf shaft. Alternatively, core material is constructed inside a golf grip such that the core material does not touch the shaft. The core provides reinforcement to minimize bending of grip material. The core may go through just one side of a grip and not surround the complete grip.

Golf club shafts vary in diameter at the butt end, the end that holds a grip. Usually, the butt end is 0.580, 0.600 or 620 inches. The diameter of a golf shaft changes going down toward the club head. In the preferred embodiment, the core expands to fit onto a shaft by material elasticity and or by core structural design.

In an alternative design, an internal support is placed within grip material and not exposed to the outside. It provides stiffness and resistance to movement especially rotation and twisting of the grip. A compression unit inside a golf shaft transfers support to a grip through the core. A compression unit is joined or interlocked to the core such that either design allows expansion.

A golf grip expands during placement and remains expanded when fully placed. The inside of the golf grip is smaller than the outside diameter of a golf club shaft so constant compression exists. Friction onto a golf shaft resulting from grip compression provides resistance to movement. The golf grip fits securely with its own compression however; it is not secure enough that movement would not occur during use. The grip is fixed securely with a compression unit. Resistance from core compression is weak enough to allow grip placement. A grip is not secure enough to play golf without securing a compression unit. In one alternative, a weak restickable adhesive or gripping material lines the inside of a core.

To augment grip stability, a compression component extends into a golf club shaft. The compression component is joined or interlocked to a grip core. The compression component and core provide adequate force to secure a grip to a golf club. In an alternative design, a rubber cap is added to the grip end to provide more stability and better feel with less vibration.

A compression component includes a central hole that accepts a key component. The key component rotates to expand the compression component. The key component has an out of round lower rotational portion. The compression unit central hole has several cross section diameters formed by internal arcs. A key placed within said hole expands the compression unit more as sections of less diameter are engaged. In the preferred embodiment, ramps and arcs provide positive position identification. Ramps and arcs further provide a stable position for said key.

In the preferred embodiment for USGA approval, the central key component includes a lower out of round section and is placed inside the compression component. The compression component has a split lower section resulting in leg like extensions. Rotation of the central key component inside the compression component engages areas of decreased diameter. The areas of decreased diameter force the compression component legs outward. Expansion of the compression unit results in compression onto the inside wall of a golf club shaft. The compression unit is joined or interlocked to the golf grip core resulting in a stabile golf grip.

Golf shafts are cut with pipe cutters resulting in constriction of a golf shaft at the orifice. A compression unit is designed so it can compress pass this constriction into a golf shaft. The lower end of a compression unit is expanded and the through cut producing said legs of the compression unit is expanded to allow movement of said legs inward if necessary. In the preferred embodiment, legs are slightly tapered in a downward direction.

In the preferred design, internal ramps force the key component to be in one of several positions. The key is either in an inactive or active compression position. The key is not stable at any position between active and inactive as forces do not allow stability. In the inactive position, the inner diameter of the compression unit is the same or larger than the diameter of the key component. In the active position, the inner diameter of the compression unit is less than the diameter of the key component.

Ramps inside the compression unit force the key to slide into one position or the other. If the key goes half way up a ramp, forces return it to the inactive position. The key is forced to the active position once it has progressed up the inactive ramp and goes over the hump to the active side. Effectively, the key snaps from one position to the other when engaging the ramps.

In the preferred embodiment designed for USGA approval, the inner central key component is either in active or inactive compression. The amount of rotation can vary but in the preferred embodiment movement rotation has several positions resulting in more or less compression.

The central key component is circular, oval, square, triangular, or like shapes in cross section to provide a snap like movement from one position to the other. The key varies in shape from top to bottom. The out of round portion may be at the top or bottom of the key. Central portions of the key are usually round to allow controlled rotation. A special tool such as a hex Allen wrench or star shaped wrench engages the top of the key component. It provides a means to transfer force to the key for rotational movement.

As an example of use, a golfer wants to try different grips on a putter to determine which grip is most comfortable and allows them to golf best. A grip is placed onto a putter shaft by pressing it downward. The grip is secure enough from core compression to test putt without tightening the compression unit. The grip is removed and the next one placed. Several grips are quickly changed and tried to determine the best one. Once a decision has been reached, the compression unit is secured. Alternatively, a golfer may cement or adhere with adhesive tape the grip, though this is not preferred.

The present design further allows a golfer to position the grip fully or partially onto a golf club shaft effectively changing golf club length. The internal compression unit must be sufficiently long into a golf club shaft to secure it however, as much as several inches change can be completed by design. Several inches of the butt end on every shaft is parallel allowing sliding of the compression unit.

A golf club shaft diameter decreases as one moves down the shaft. The end of a golf grip has a matching smaller diameter to the point it will sit on a shaft. A grip core is split into sections at the end to allow expansion. When the end of a golf grip is placed onto a golf club shaft, it expands. The end of the core may have one or many splits for expansion. In the preferred embodiment, the end remains in compression for greater stability.

In the preferred embodiment, a core inside a grip has a long split starting from the top and extends part way down the core. Another split starts at the opposite end of the core in a different plane and goes part way up and passes the opposite split. This offset split construction minimizes movement and rotation while allowing expansion and maximum compression. Splits do not need to go to the end of the core to allow grip expansion.

An outside grip component is molded directly onto an inner core or manufactured separately and secured with adhesives, interlock, snaps, friction or like methods. Components can be constructed with various coatings or layers such as rubber on the inside or outside.

A key component turns inside a compression unit resulting in the expansion of the compression component inside a golf club shaft. A snap component which is shaped inside the lower part of the compression unit, engages the key component. A ramp formed as a projection acts as a snap so when the inner key component is turned, it cannot stay on a ramped areas. The key must go past the projection to provide compression unit engagement. It cannot stop part way and thus will be acceptable to USGA requirements. In the preferred embodiment, ramps and holding areas are formed by a series of arcs.

As an alternative, shapes such as a rounded rectangle shape simulate the desired ramp action though it is not arc shaped.

In the present invention, multiple ramps and arcs are used to provide different inner diameters resulting in different amounts of expansion of a compression unit. In addition, different ramp sizes are used to control key movement.

For example, inside a compression unit, four ramps are on the left side and four ramps on the right side. A key strikes two ramps at the same time when rotated. It strike one on the right and one on the left side. The key goes over the smallest ramp first. If the first two ramps on the right side are smaller than the first engaged ramp on the left, the key moves over these ramps first. If the third ramp on the right is larger than the one on left, the key will move over the left ramp.

The foregoing has outlined the more pertinent and important features of the present invention in order that the detailed description of the invention that follows may be better understood, and the present contributions to the art may be more fully appreciated. It is of course not possible to describe every conceivable combination of components and/or methodologies, but one of ordinary skill in the art may recognize that many further combinations or permutations are possible. Accordingly, the novel architecture described below is intended to embrace all such alterations, modifications, and variations that fall within the spirit and scope of the appended claims.

There has thus been outlined, rather broadly, the more important features of the versatile compression interchangeable golf grip system and series of accompanying systems and apparatuses and embodiments in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

To the accomplishment of the foregoing and related ends, certain illustrative aspects are described herein in connection with the following description and the annexed drawings. These aspects are indicative of the various ways in which the principles disclosed herein can be practice and all aspects and equivalents thereof are intended to be within the scope of the claimed subject matter. Other advantages and novel features will become apparent from the following detailed description when considered in conjunction with the drawings.

BRIEF DESCRIPTION OF THE DRAWINGS

The advantages of the present apparatus will be apparent from the following detailed description of exemplary embodiments thereof, which description should be considered in conjunction with the accompanying drawings, in which: Having thus described the system in general terms, reference will now be made to the accompanying drawings, which are not necessarily drawn to scale, and wherein.

DETAILED DESCRIPTION OF THE PREFERRED EMBODIMENTS

Figure 1:
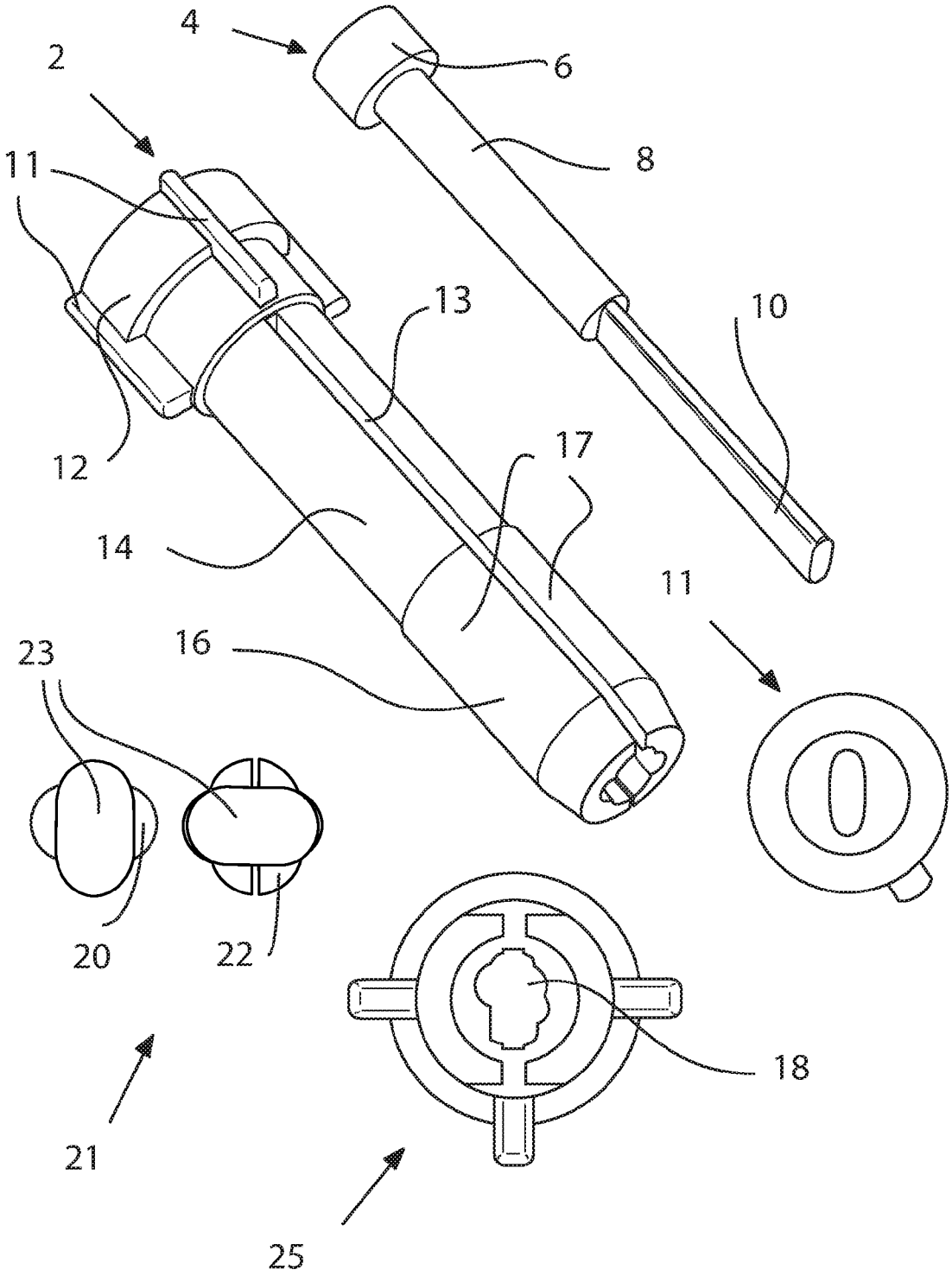
FIG. 1 illustrates an isometric and cross section view of the compression unit of this invention.

Referring to FIG. 1, compression unit 2 and key 4 are illustrated. Key 4 has upper wrench engaging section 6, rotation stabilizer 8 and engaging section 10 which is slot or oval cross section shape as seen by bottom view 11. Compression unit 2 has upper stabilizing section 12 with wings 11 that join or interlock to a core or grip, central section 14 and lower engaging section 16 that presses onto the inside walls of a golf shaft. Engaging section 16 is increased in diameter when compared to central section 14 or is the same or less diameter. In the preferred embodiment, lower central section 14 and engaging section 16 is tapered starting wider at the top and getting narrower toward the distal end.

Wings 11 are joined to a core or are interlocked into slots. Slots slide on said wings allowing expansion of a core if necessary. As few as one wing is used however, three or four is the preferred number. Central section 14 and engaging section 17 have split 13 which go completely through the lower segment to form two legs 17.

Decrease diameter in the internal configuration of compression unit 2 causing expansion of legs 14 when key 4 is rotated is demonstrated in end view 21. Key 23 is vertical and in a space the same size or larger resulting in no leg separation as seen in view 20. When key 23 is turned horizontal, the decreased internal diameter of the compression unit results in legs being pressed outward for engagement as seen in view 22. A representation of the preferred embodiment showing internal arc placement is seen in bottom view 25 and multiple internal arcs 18.

Figure 2:
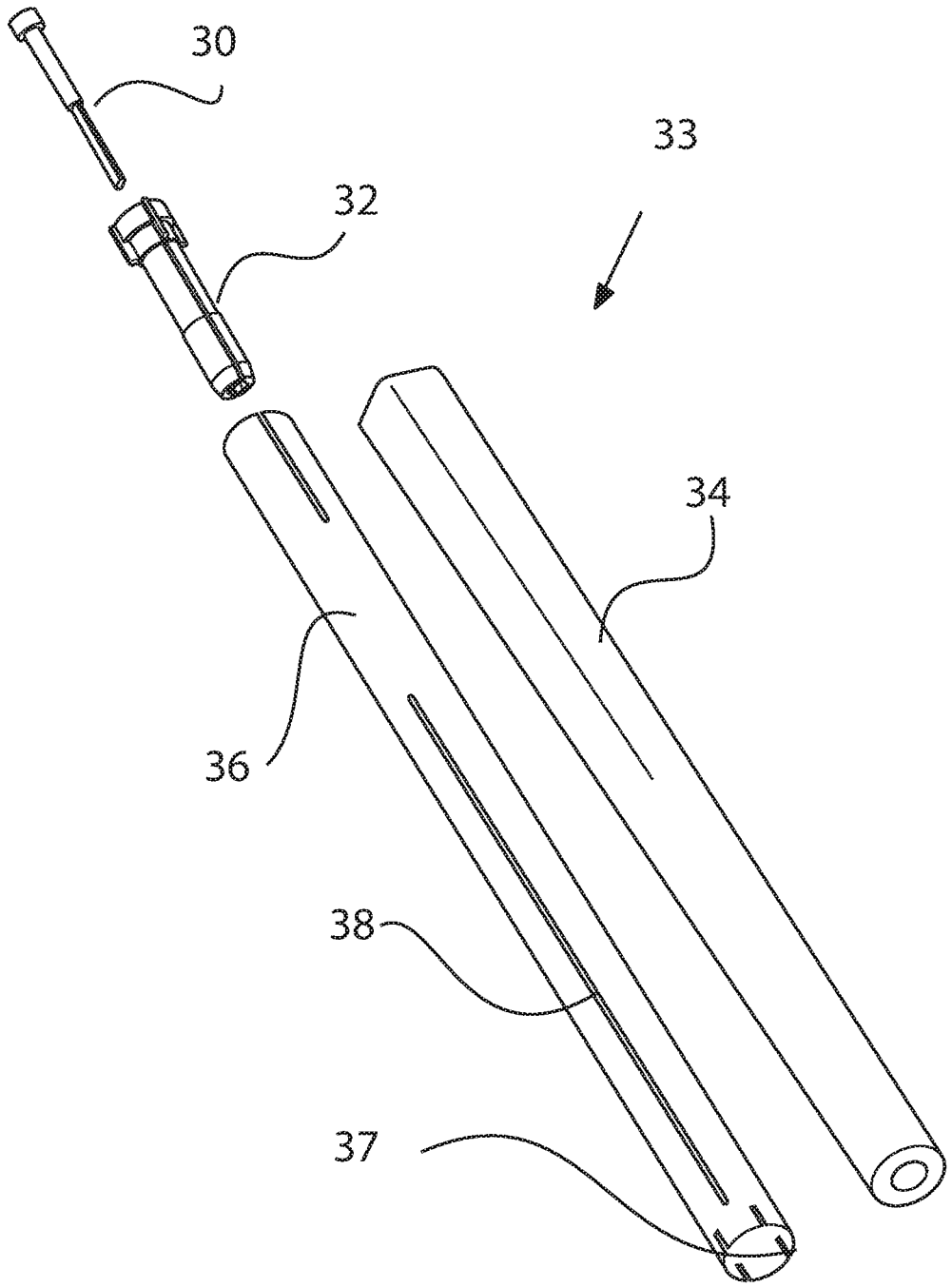
FIG. 2 illustrates an isometric view of this invention.

Referring to FIG. 2, golf grip 33 has key 30 that is placed into compression unit 32 that is placed into core 36. Core 36 utilizes slots 38 and 37 to allow expansion. Slots extend to the end of said core or are within core material. More slots are used to control expansion depending on rubber material and design and the amount of required expansion. Grip material 34 is placed over core 36 either by joining or directly injection molding or the like onto core 36.

Figure 3:
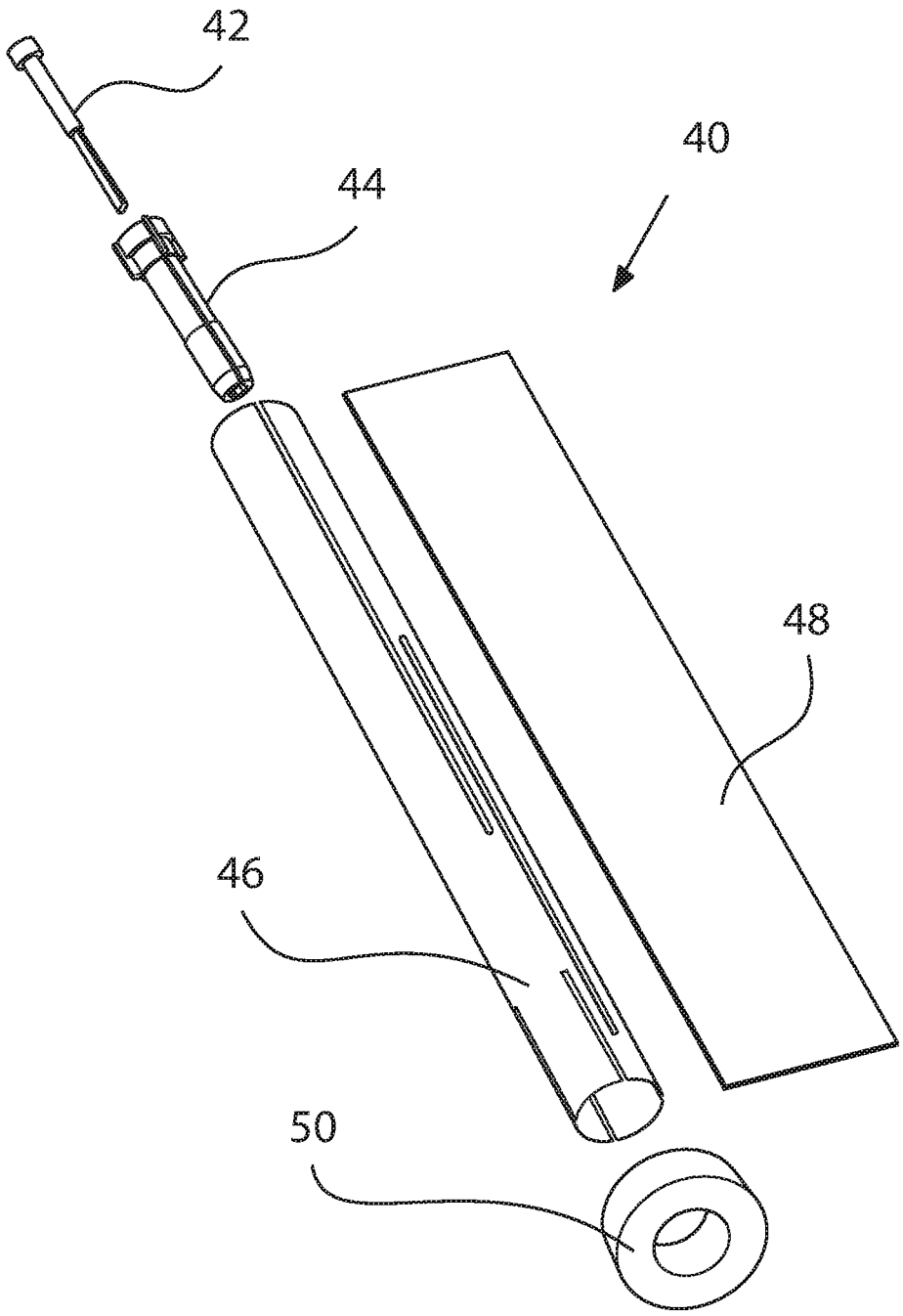
FIG. 3 illustrates an isometric view of an alternative golf grip of this invention.

Referring to FIG. 3, key 42 is placed into compression unit 44, which is placed into core 46. Core 46 is wrapped with cover sheet 48 which is adhered and or sewn into position on said core. Rubber cap 50 is joined to the end of core 46 to provide stabilization on a golf shaft. Rubber cap 50 may cover over and or enter into the inner portion of core 46.

Figure 4:
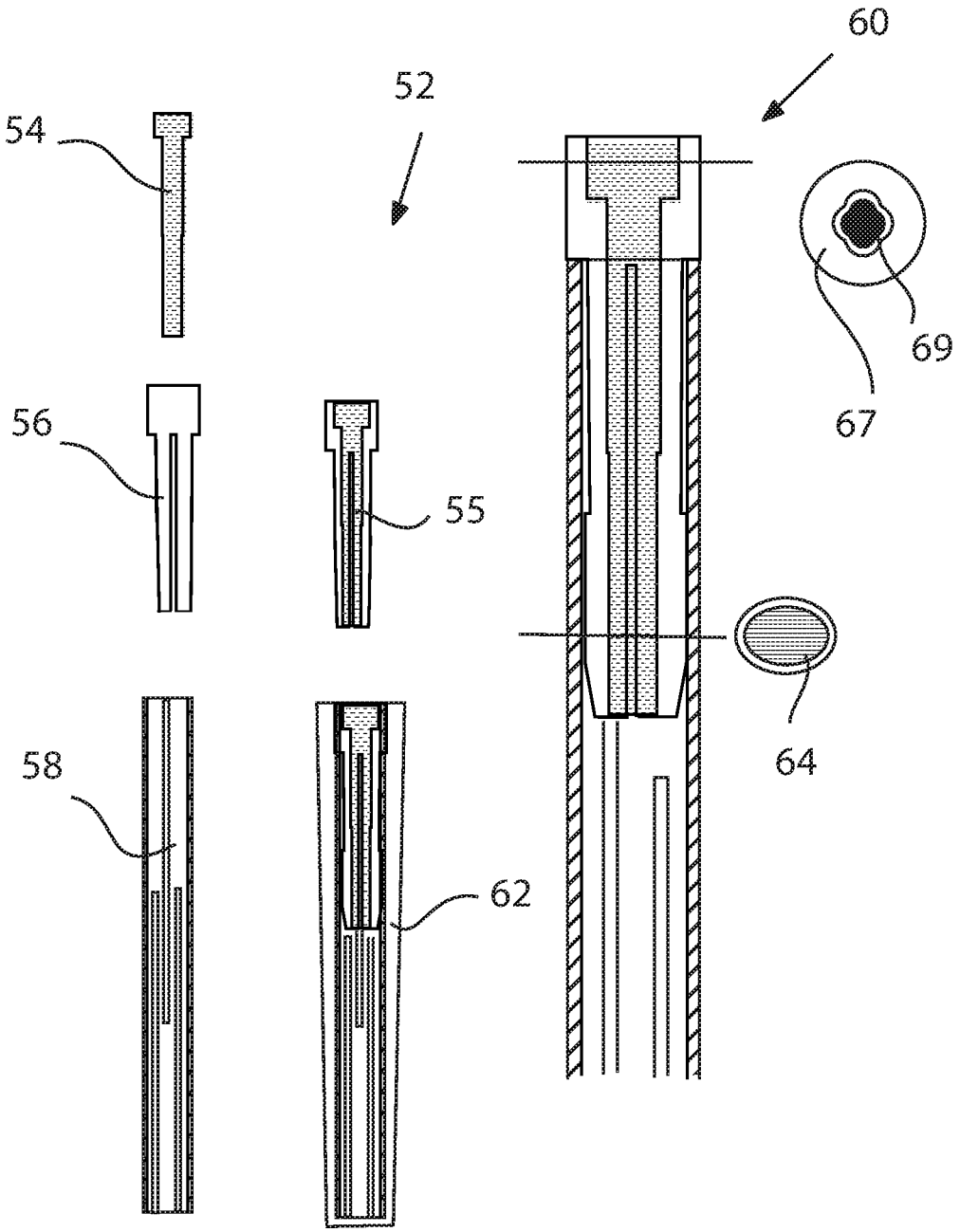
FIG. 4 illustrates a cross section view of a golf grip of this invention.

Referring to FIG. 4, key 54 is placed into tapered compression component 56 to produce assembled compression unit 55. Compression unit 55 is placed into core 58 to produce compression core 62. A tapered compression unit expands to become parallel to shaft sides and maximize contact.

Compression unit 60 has upper compression cross section 67 which provides a snap when upper key shown in cross section 69 is turned. Ramps in the upper segment act in the same fashion as when ramps are in the lower section to control key position in an active or inactive position. Lower segment cross section 64 is oval with no ramps to expand compression unit legs when rotated. This configuration reduces forces onto the compression unit legs.

Figure 5:
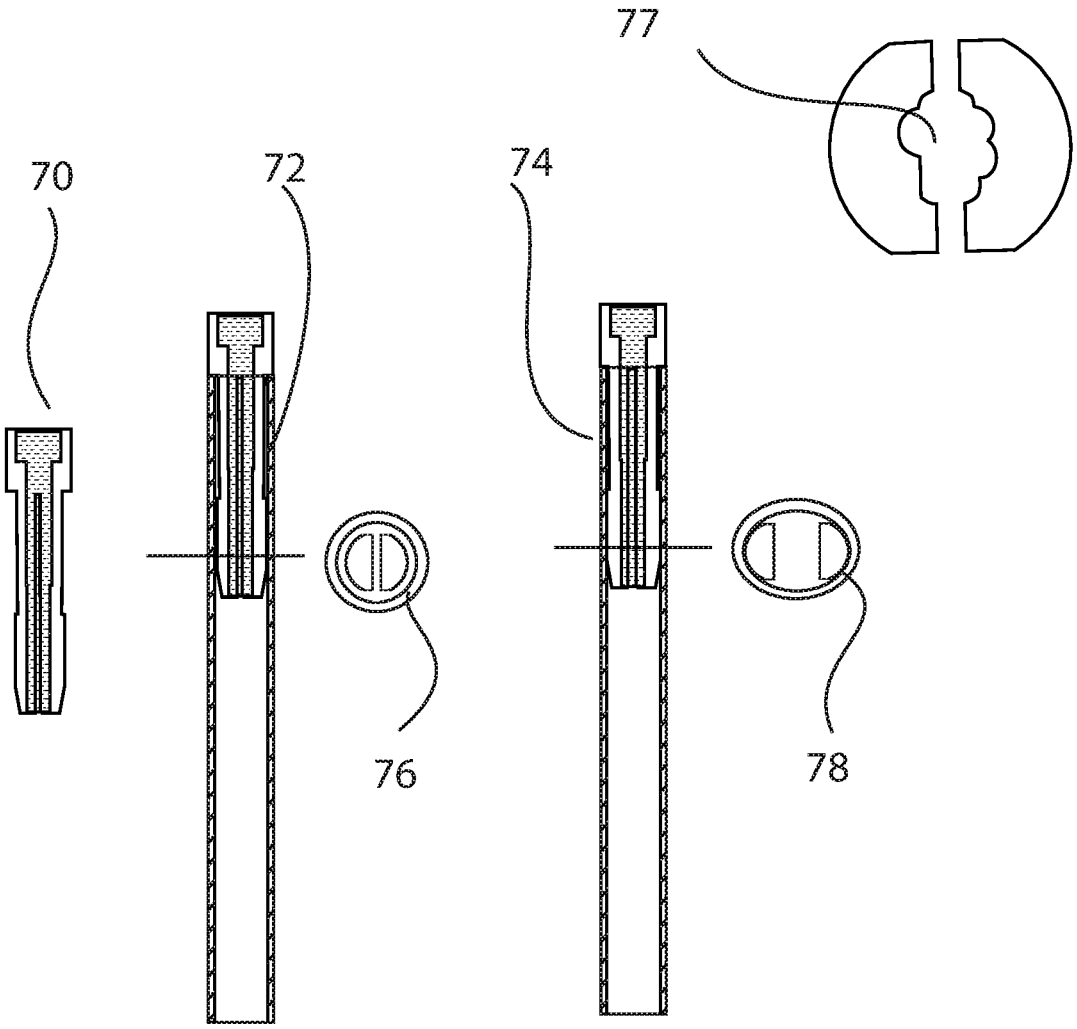
FIG. 5 illustrates a cross section view of a compression unit of this invention.

Referring to FIG. 5, compression unit 70 is placed into a core in an inactive position as seen in assembled cross sections 72 and 76. Compression unit 74 is in the active position and is designed to compress and expand a shaft as seen in cross section 78. Shaft expansion results from the compression unit pushing outward. Shaft expansion is greater when the diameter of the compression unit is less than the inner diameter of the shaft. The reduced diameter circle reduces the contact area onto the inside of a shaft. Distortion of a shaft from a compression unit aids in resistance to rotational or dislodging forces. Cross section 77 of the lower segment of a compression unit shows the preferred shape for expansion for two different diameter shafts such as a 0.580 and 0.600 inch. The large arc on the top left side acts as an anchor to stop key rotation on that side.

Figure 6:
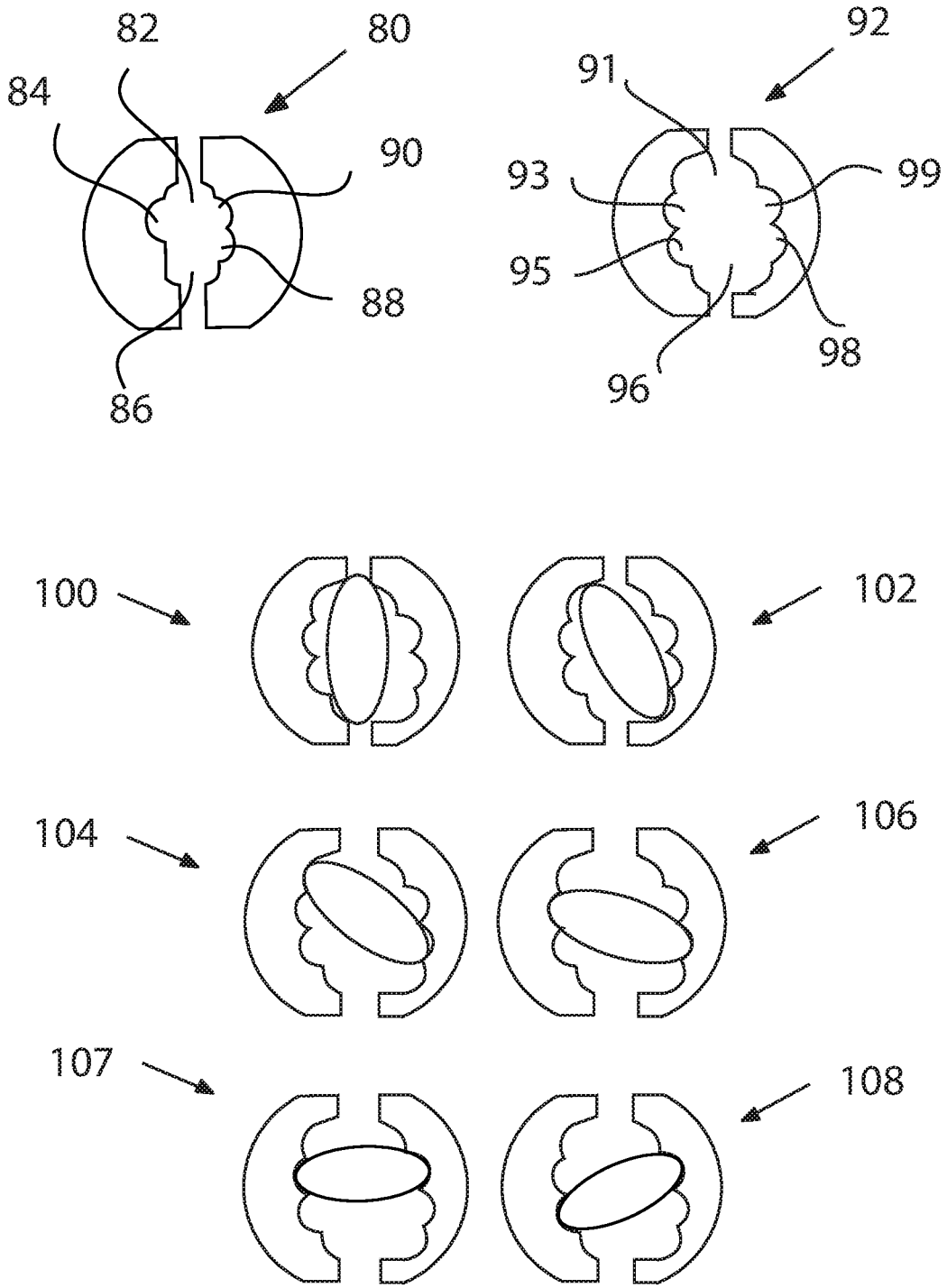
FIG. 6 illustrates cross section views of a compression unit of this invention.

Referring to FIG. 6, compression unit 80 is a cross section view of its lower segment. The inside arc configuration is ideal to accommodate two shaft sizes. A key is placed into a compression unit into areas 82 and 86 as seen in cross section 100.

Counter clockwise rotation of the key places it into arc 84 and 88. The shape of each arc is similar in size and shape to the key. The lower part of arc 84 has a large ramp which prevents more rotation. Arc 84 becomes an anchor point. The lower part of the key enters arc 90 with more key rotation while the other side is in arc 84. The distance from arc 84 to arc 90 is less than arc 84 to arc 88 so more expansion occurs.

Controlling ramp size on either side of an arc determines the order in which each arc is entered when a key is rotated. For example, compression unit 92 shows a cross section with passive areas 91 and 92 and engagement arcs 93, 95, 98 and 99. Cross section 100 shows a key in a passive position such that no force is applied to the compression unit. Initial rotation of the key is designed to be passive as seen in cross section 102. From passive position 102, outside ramps of arc 93 and 98 are engaged with key rotation. Because arc 93 has a larger ramp, more force is required for the key to go over it than the smaller ramp of arc 98. As the key turns, it stays in arc 93 and moves to arc 98 as seen in cross section 104. The size of ramps is differential though out so that the key moves from one arc to the next as seen in cross sections 106, 107 and 108. The decreased distance between arcs results in more compression unit expansion.

Figure 7:
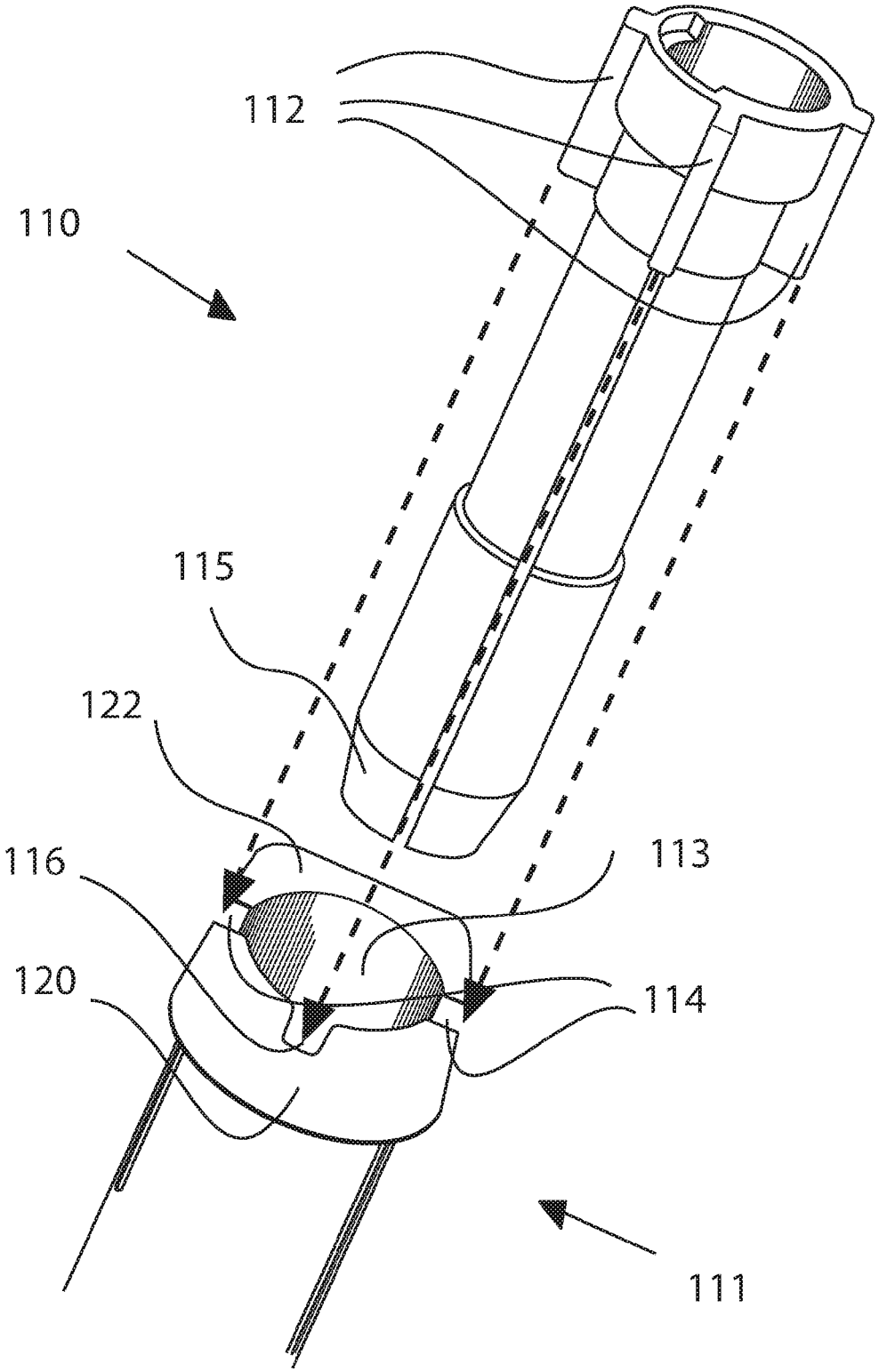
FIG. 7 illustrates an isometric view of a compression unit and core of this invention.

Referring to FIG. 7, end 115 of compression unit 110 enters core 111 at opening 113. Wings 112 of compression unit 110 enter side slots 114 and back slot 116. Side slots 114 extend down the core to allow expansion when being placed onto a golf shaft such that upper segment 122 separates from lower segment 120 and slots 114 expand. Compression unit 112 is placed passively or in the preferred embodiment, joined to lower segment 120 by welding, adhesives or the like.

Figure 8:
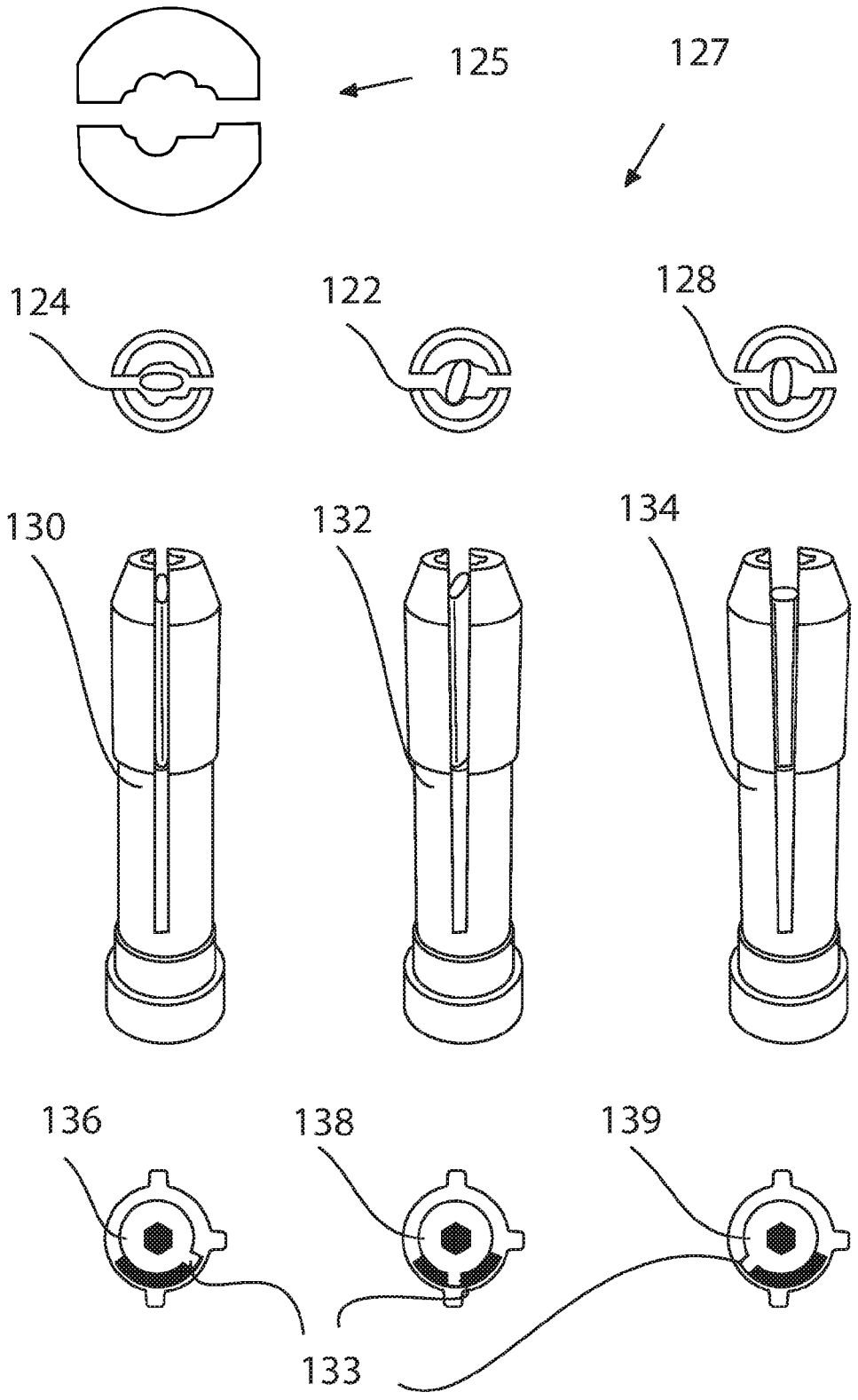
FIG. 8 illustrates an isometric and cross section view of the bottom, side and top of a compression unit of this invention.

Referring to FIG. 8, compression unit 127 has internal arcs and ramps as seen in end view 125. When a slot shaped key is turned in the compression unit, it engages different arcs to open the compression unit. Different arcs create different internal diameters. The internal key has extension 133 which limits movement by being placed in an open channel that limits turning to 180 degrees or less. Extension 133 stops the key from turning beyond the last arcs which would cause disengagement. At each end of the compression unit hole are walls to stop further rotation.

Top line FIGS. 124, 122 and 128 show a bottom view of a compression unit and key. The center line of FIGS. 130, 132 and 134 shows a side view and the bottom line of FIGS. 136, 138 and 139 shows a top view. View 124, 130 and 136 show a compression unit and key in a passive position. View 122, 132, and 138 shows a compression unit and key in an expanded engaging position and view 128, 134 and 139 shows a compression unit and key in a fully engaged position for a larger shaft diameter. In use, position 132 would engage a 0.580 inch shaft and position 134 would engage a 0.600 inch shaft.

Figure 9:
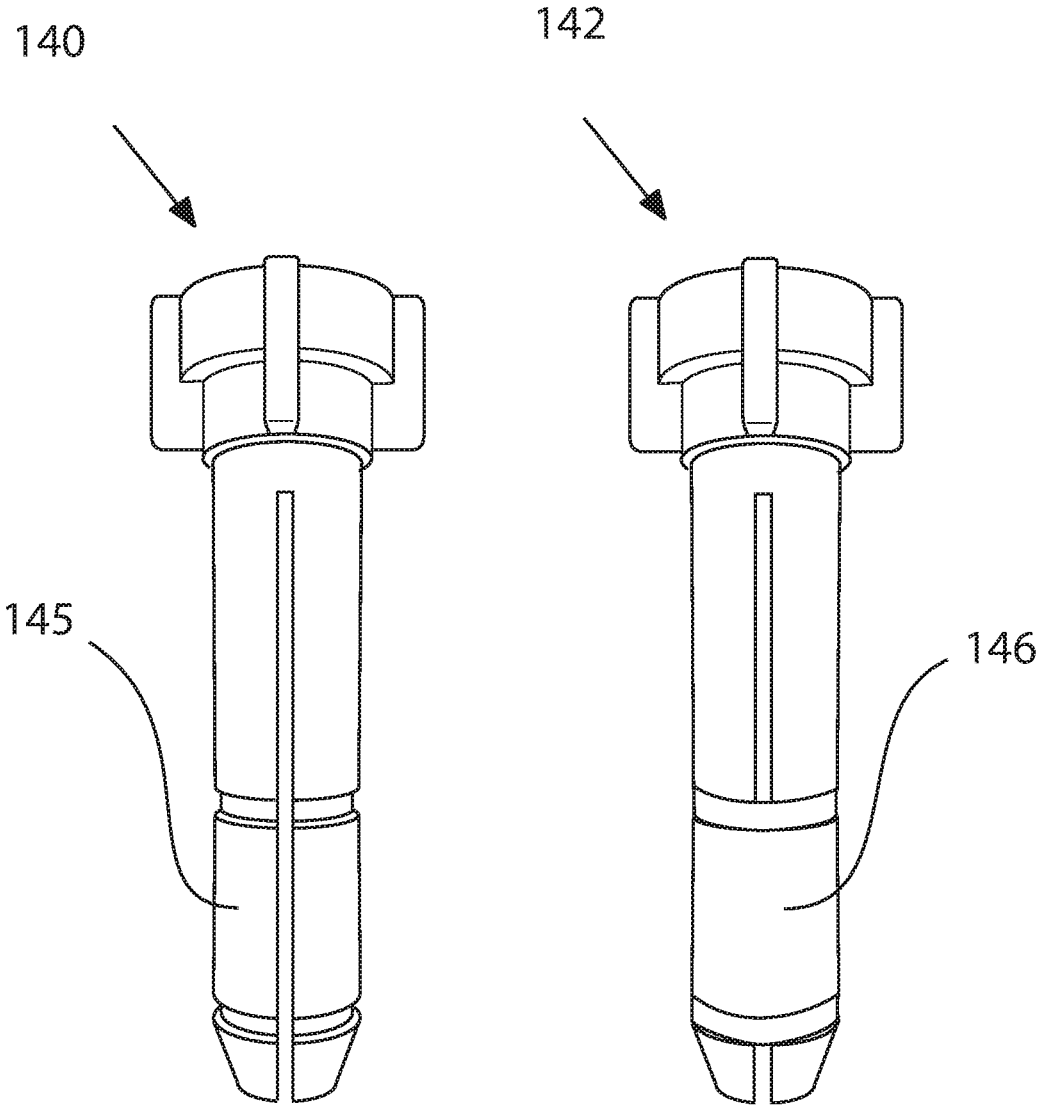
FIG. 9 illustrates an isometric view of an alternative compression unit of this invention.

Referring to FIG. 9, compression unit 140 has double sided adhesive tape, anti-skid, or adhesive material on section 145 to aid in securing the unit to a golf club shaft. Compression unit 142 has similar materials wrapped around section 146.

The invention claimed is:

1. A golf club grip that includes:

a snap compression unit that enters into a golf club shaft comprises;

an inner component which is an internal key and said internal key has a bottom section being out of round such that it is of greater diameter in one direction than another; and an outer component with a variable internal hole cross section, said internal hole cross section in a passive direction is of the same or greater diameter than the greatest diameter of the said bottom section of said internal key and less than the greatest diameter of the said bottom section of said internal key in several different directions than the passive direction, said variable internal hole cross section with a varying diameter results in variable expansion of the outer surface of the outer component and thus variable compression of the outer component when the outer surface contacts the inner wall of a shaft when said internal key is rotated, and said outer component has an inner wall with a several ramp profile to create multiple expansions of the outer component as the greatest diameter of the said bottom section of said internal key moves along a ramp and a snap action between the internal key and outer component as the greatest diameter of the said bottom section of said internal key moves passed the ramp.

2. The golf grip of claim 1, wherein the ramps of the internal wall of said outer component are the same size.

3. The golf grip of claim 1, wherein the ramps of the internal wall of said outer component are different sizes.

4. The golf grip of claim 1, wherein two outer layers are placed on the outer surface of the shaft, an inner layer of said two layers being a central core with a smaller inside diameter then an outer diameter of the shaft, and said central core expands during placement causing compression on the shaft.

5. The golf grip of claim 4, wherein a rubber piece extends beyond said core end.

6. The golf grip of claim 1, wherein a rubber piece extends beyond a grip end.

7. The golf grip of claim 1, wherein said outer component outside diameter is less than the inner diameter of the golf shaft and compresses beyond the inner diameter of a golf shaft resulting in shaft distortion.

8. The golf grip of claim 1, wherein said outer component has an outer layer of material on a lower section.

9. The golf grip of claim 8, wherein the outer layer is adhesive.

10. The golf grip of claim 8, wherein the outer layer is a gripping material.

* * * * *